US005333732A

United States Patent [19]

Budny et al.

[11] Patent Number: 5,333,732

[45] Date of Patent: Aug. 2, 1994

[54] LENS PACKAGE

[75] Inventors: Thomas F. Budny, Novato; Anthony G. Schenna, Santa Monica, both of Calif.; Larry D. Durham, Terre Haute, Ind.

[73] Assignee: Ivy Hill Corporation, New York, N.Y.

[21] Appl. No.: 78,573

[22] Filed: Jun. 17, 1993

[51] Int. Cl.[5] ..... B65D 85/38

[52] U.S. Cl. ..... 206/316.1; 206/5; 206/594; 206/804

[58] Field of Search ..... 206/5, 254, 255, 273, 206/316.1, 594, 804, 817; 229/11, 20; 220/416

[56] References Cited

U.S. PATENT DOCUMENTS

| | | | |
|---|---|---|---|
| 260,113 | 6/1882 | Munson | 229/20 |
| 381,889 | 4/1888 | Scott | 206/254 |
| 512,011 | 1/1894 | Colgan | 206/254 |
| 662,560 | 11/1900 | Floyd | 229/11 |
| 1,684,556 | 9/1928 | Rosenberg | 206/594 |
| 1,816,321 | 7/1931 | Foss | 206/594 |
| 2,667,965 | 2/1954 | Laibson | 206/5 |
| 2,966,985 | 1/1961 | Morris | 206/5 |
| 3,212,689 | 10/1965 | Woolfolk | 206/254 |
| 3,286,825 | 11/1966 | Laas | 206/594 |
| 3,938,655 | 2/1976 | Romolt | 206/5 |
| 4,175,675 | 11/1979 | Maisonneuve | 229/11 |
| 4,388,999 | 6/1983 | Berry et al. | 220/416 |
| 4,479,588 | 10/1984 | Davis et al. | 220/416 |

*Primary Examiner*—David T. Fidei

*Attorney, Agent, or Firm*—Amster, Rothstein & Ebenstein

[57] ABSTRACT

A package for an optical lens blank in the form of a parallelepiped carton includes an internal major side panel connected to a bottom major end panel by a foldline and extending generally parallel and adjacent to the front major side panel and an internal major end flap connected to the internal major side panel by a foldline. A strip of non-abrasive material or a surface coating extending over the facing surfaces of said back and internal major side panels.

25 Claims, 4 Drawing Sheets

FIG. 3
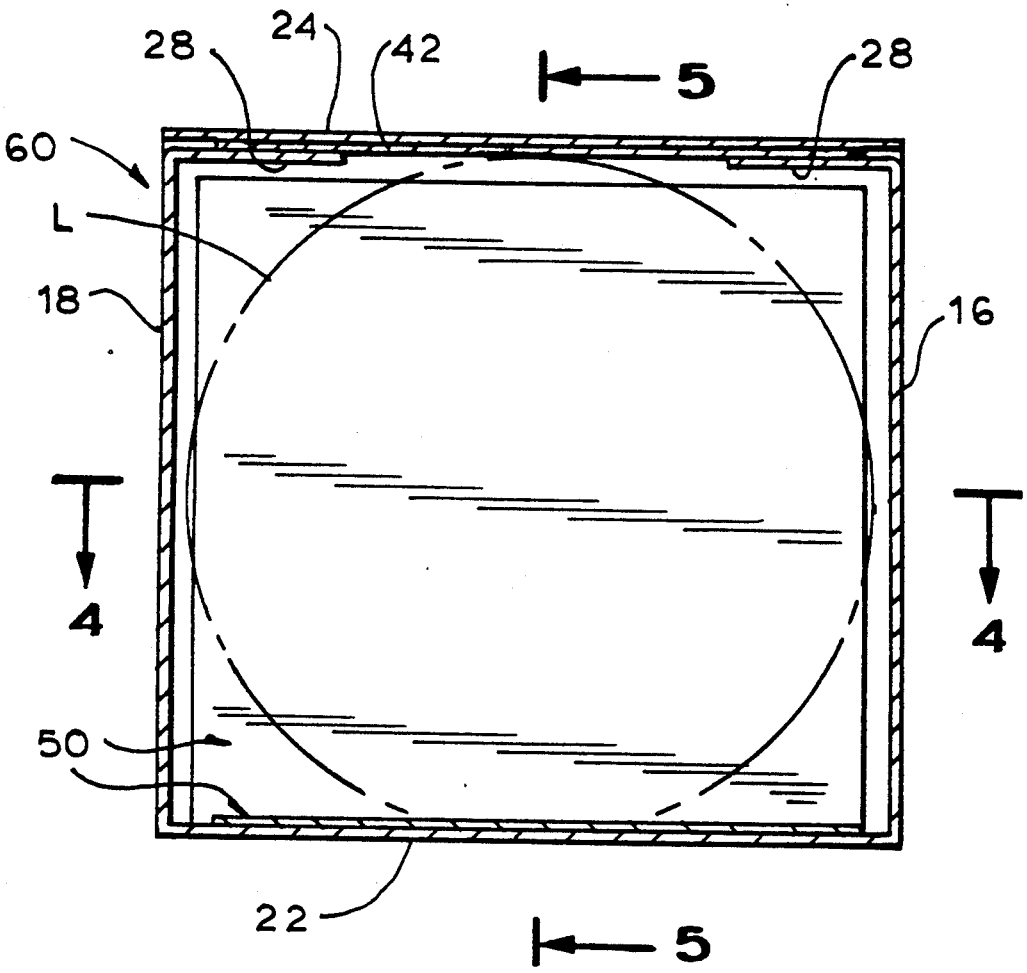
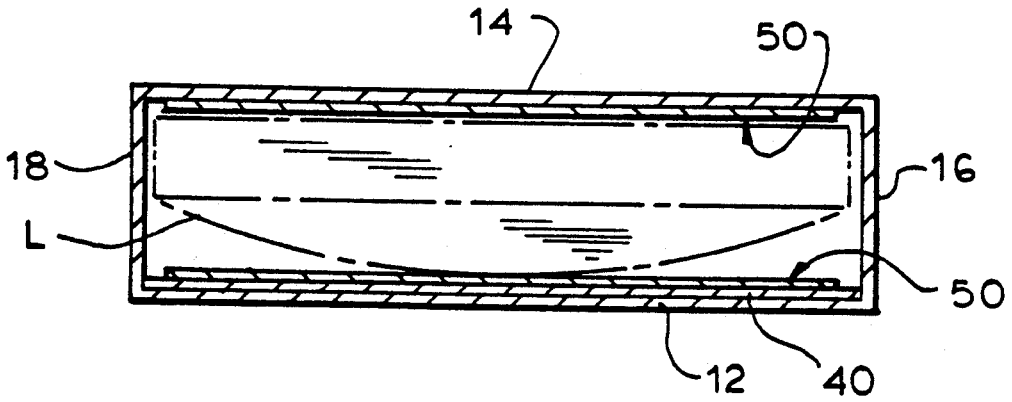
FIG. 4

LENS PACKAGE

BACKGROUND OF THE INVENTION

The present invention relates to a lens blank package and more particularly to such a package which protects the lens blank from being scratched without the need for additional protective wrapping.

Typically an optical lens blank of the type employed in eyeglasses must be shipped from the manufacturer of the lens blank to an optical laboratory which cuts the lens blank to shape and polishes it as necessary to provide the desired functionality, and finally to the retail optician who places the lens in the eyeglasses. Additionally, frequently, cut lenses are returned by the retail optician to the wholesale optician or optical laboratory for tinting, correction, or the like. Each lens blank is typically shipped in a separate carton. The carton is typically a conventional parallelepiped carton having a pair of major side panels, a pair of minor side panels connected to the major side panels by foldlines, and a pair of major end panels connected to respective major side panels or the same major side panel. The carton is typically a double tuck end carton so that there is a tuck flap connected to the top major end panel and optionally a pair of dust flaps connected to the pair of minor side panels at both ends of the package. As the paperboard material from which the carton is formed typically is coated on only one side thereof to facilitate printing thereof, especially color printing on the exterior surface of the carton, the interior surface of the carton is uncoated and therefore is even rougher than the exterior thereof.

In order to prevent the scratching of the lens blank by the carton during packing, transport, and unpacking, the lens blank is wrapped in a non-abrasive tissue paper which is substantially less abrasive to the lens than the interior surface of the carton. Preferably, the tissue paper is manually wrapped about the lens blank and thereafter the wrapped lens blank is placed in the carton. Furthermore, there have been some indications recently that the operations of folding in minor end panels and tucking flaps of narrow cartons are repetitive actions which, when done manually by workers continuously during a work shift, lead to complaints of carpal tunnel syndrome in the hands of such workers. A further disadvantage of this procedure is that, when the lens is finally removed from the package, there is both the package and the non-abrasive material to be disposed of.

In order to preclude the lens blank shifting around within the package during transport, and thereby minimize scratching of the lens due to its movement, relative to the carton, either sufficient non-abrasive material must be employed in the package or additional non-abrasive material must be added to the package by the person inserting the lens. The appropriate amount of non-abrasive material to be employed to prevent shifting cannot be accurately predicted since lens blanks vary substantially in thickness depending upon the strength thereof, etc. Where the original wrapping of non-abrasive material is inadequate to make the lens blank fit snugly within the carton there is a need to manually rewrap the lens blank or stuff additional non-abrasive material within the carton. This additional operation is time consuming.

Accordingly, it is an object of the present Invention to provide a lens blank package which protects the lens blank or the finished lens therein against scratching without requiring pre-wrapping of the lens blank with non-abrasive material.

A further object is to provide such a package which accommodates both thin and thick lenses to prevent them from shifting without varying the amount of non-abrasive material wrapped around the lens blank.

It is another object to provide such a package which is economical to manufacture and simple to use.

It is a further objective to ease the fatigue factor by providing a carton construction which can be easily erected and prepared for filling after a simple one-hand squeeze motion.

SUMMARY OF THE INVENTION

It has now been found that the above and related objects and features of the present invention are obtained in a first embodiment of the lens package according to the present invention wherein the lens package comprises a parallelepiped carton with front and back major side panels. A pair of minor side panels is connected to the major side panels by foldlines. There is a bottom major end panel connected to the back major side panel by a foldline at the bottom end of the carton. At the top end of the carton there is a top major end panel connected to one of the back or front major side panels by a foldline. A tuck flap is connected to the top major end panel by a foldline and there are a pair of dust flaps connected to the top of the pair of minor side panels by foldlines. There is an internal major side panel connected to the bottom major end panel by a foldline and extending generally parallel and adjacent to the front major side panel and an internal major end flap connected to the internal major side panel by a given foldline.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanied drawing wherein:

FIG. 3 is a sectional view of the package in a closed orientation, with a lens blank within the package being illustrated in a phantom line;

FIGS. 4 and 5 are sectional views thereof taken along the lines 4—4 and 5—5, respectively of FIG. 3, with a relatively thick lens blank being illustrated in a phantom line;

DETAILED DESCRIPTION OF PREFERRED EMBODIMENTS

Figures 1, 7:
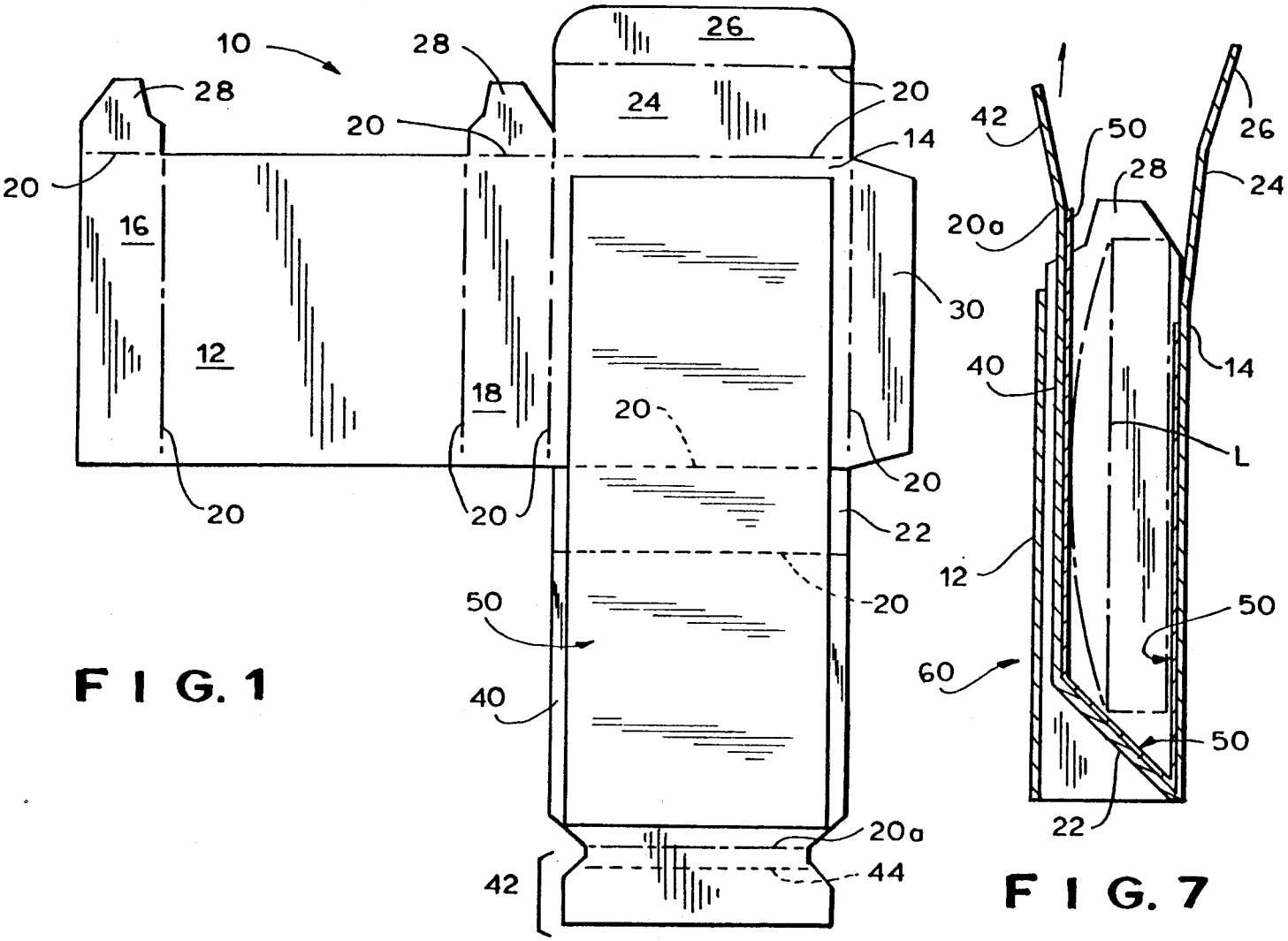
FIG. 1 is a top plan view of a carton blank according to the present invention for use in forming the lens blank package.
FIG. 7 is a sectional view similar to FIG. 6 but with the package in the open orientation and the bottom panel thereof elevated.

In its conventional aspects, the blank 10 for a lens blank package in the form of a parallelepiped carton comprises a front major side panel 12, a back major side panel 14, and a pair of minor side panels 16, 18, each minor side panel 16, 18 being connected to at least one of the major side panels 12, 14 by a foldline 20. A bottom major end panel 22 is connected to the back major side panel 14 by a foldline 20 and a top major end panel 24 is connected to the back major side panel 14 by a foldline 20. A tuck flap 26 is connected to the top major end panel 24 by a foldline 20, and a pair of dust flaps 28 are each connected to one of the minor side panels 16, 18, respectively, by a foldline 20. Alternatively, the top major end panel 24, tuck flap 26 and dust flaps 28, 28 may be attached to the front major side panel 12 by a foldline 20.

A glue flap 30 is disposed on the side of the back panel 14 opposite the minor side panel 18 and is glued to the other minor side panel 16 in the erected carton. It will be appreciated that the bottom major end panel 22 defines the bottom end of the carton while the top major end panel 24, tuck flap 26 and the dust flaps 28 (also, referred to as "top minor end panels") define the top of the carton. The front and back major side panels 12, 14 and the minor side panels 16, 18 (along with the glue flap 30) define the body of the carton intermediate its top and bottom ends.

Turning now to the novel aspects of the present invention, in one preferred embodiment an internal major side panel 40 (hereinafter referred to as the "internal panel") is connected to the bottom major end panel 22 by a foldline 20 so that it is pivotable thereabout to extend upwardly, generally parallel and adjacent to the front major side panel 12 in the erected carton. An internal major end flap 42 is connected to the internal panel 40 by a given foldline 20*a*. It will be appreciated that the major side panels 12, 14 and 40 are each of substantially the same dimensions, which will, of course, depend upon the anticipated diameter of the lens blank being inserted into the package, this in turn depending upon the type of lens — that is, whether it is for a single lens blank for eyeglasses, a telescope, a magnifier, or the like. Preferably the internal major end flap 42 defines a line of weakness 44 (such as a perforated line) parallel to and closely spaced from the given foldline 20*a* connecting the internal major end flap 42 to the internal panel 40. As described below, the major end flap 42 may be folded along the line of weakness 44 in order to adapt the carton to accommodate thick or thin lens blanks. Additionally, the internal major end flap 42 may contain more than one line of weakness 44 to accommodate lens blanks of varying thicknesses.

In another preferred embodiment, the blank 10 additionally includes non-abrasive material generally designated 50 which is disposed on the facing surfaces of the major side panels when the carton is erected. As illustrated in FIG. 1, the non-abrasive material 50 is in a form of a strip which extends from adjacent the top of the back major side panel 14, downwardly for substantially the entire length of the back major side panel 14, transversely across the inner surface of bottom major end panel 22, and upwardly for substantially the length of the internal major side panel 40 to adjacent the top thereof, when the carton is in the erected orientation. In other words, the strip 50 extends from adjacent the top major panel 24 to the internal major end flap 42. The non-abrasive material 50 may be a strip of non-woven material. Alternatively, such material may be a coating of a compound of foam, plastisol, Teflon or the like applied directly to the inner surfaces of the carton.

Because the weight of the lens in the erected carton rests on the bottom major end panel 22, preferably the interior surface thereof, like the interior surfaces of the back and internal major side panels 14, 40 adjacent the lens are covered by the non-abrasive strip 50. However, since the major surfaces of the lens requiring protection are the front and back thereof, rather than the sidewalls, the non-abrasive strip 50 may be disposed so as to cover the facing surfaces of the back major side panel 14 and the internal panel 40 and covering the bottom major end panel 22 may be dispensed with. In this instance, the strip 50 would extend from adjacent the glue panel 30 across the back major side panel 14, across the minor side panel 18, and across the front major side panel 12 to adjacent the other minor side panel 16, or "side-to-side", in the orientation of FIG. 1 (not shown).

Figure 2:
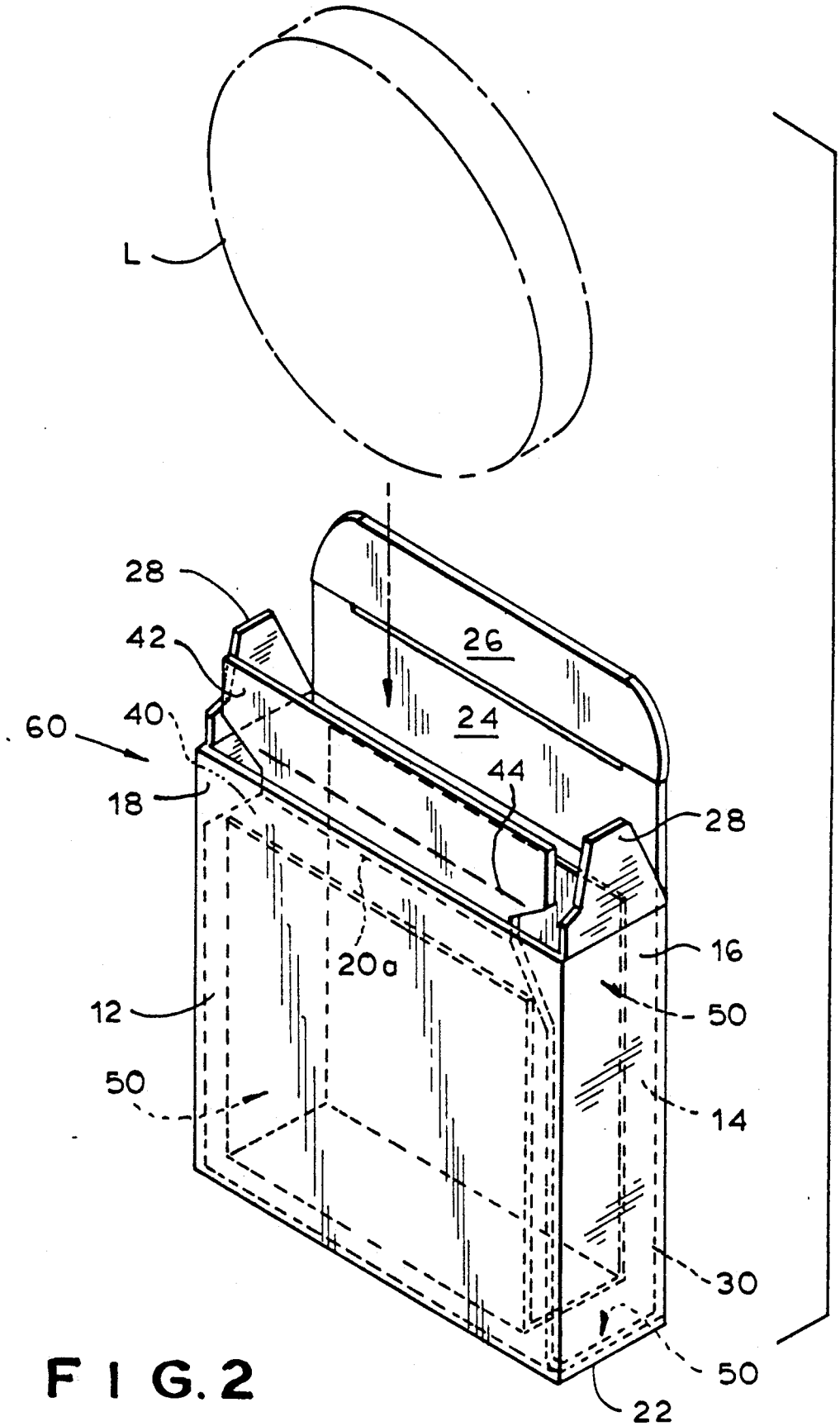
FIG. 2 is an isometric view of a lens packaging according to the present invention in an open orientation, with a lens blank, illustrated by phantom lines, being positioned for insertion therein.

Referring now to FIG. 2, therein illustrated is a carton 60 made from the blank 10 according to the first embodiment of the present invention. The package 60 is illustrated in its open position — that is, the cover, defined by the top major panel and top tuck flap 24, 26, the dust flaps 28, 28 and the internal flap 42 are upright (that is, in the same plane as the back major sidewall 14, the minor side panel 16, and the internal panel 40, respectively). Thus, the package 60 is in appropriate position to receive a lens blank L (illustrated in phantom line).

The preferred embodiment of the carton 60 of the present invention is self-erecting. In particular, the blank 10 is assembled so that the internal major side panel 40 is folded upwardly to overlie the back major side panel 14 prior to gluing. Thereafter, glue flap 30 is glued to minor side panel 16. The carton 60 is still in a flat state (not shown). In order to erect carton 60 from its flat state to the orientation shown in FIG. 2 it is only necessary to compress or squeeze the sides of the flat carton towards each other. In particular, the carton 60 is erected by applying a force to the opposite foldlines 20, 20 between the minor side panel 18 and the front major side panel 12 and the minor side panel 16 and the back side panel 14 or between the back major side panel 14 and the inner side panel 18 and the front major side panel 12 and the minor side panel 16 depending on whether the glued blank is folded to the left or right. The face is applied until the carton assumes the configuration wherein the minor side panels 16, 18 are substantially perpendicular to the front and back major side panels 12, 14. Thereafter, the internal major side panel 40 is pushed downwardly causing the major bottom flap 22 to rotate about its foldline 20 and the carton assumes the orientation of FIG. 2 and is ready for the insertion of the lens blank L.

As shown by the arrow in FIG. 2, lens blank L is inserted into the carton 60 through the open top of the carton. Using the carton of the present invention obviates the need to pre-wrap the lens blank L with non-abrasive material prior to insertion into the carton 60. The self-erecting feature also avoids the need to fold in minor end panels or tucking flaps as required to close the bottom of conventional cartons.

Figure 6:
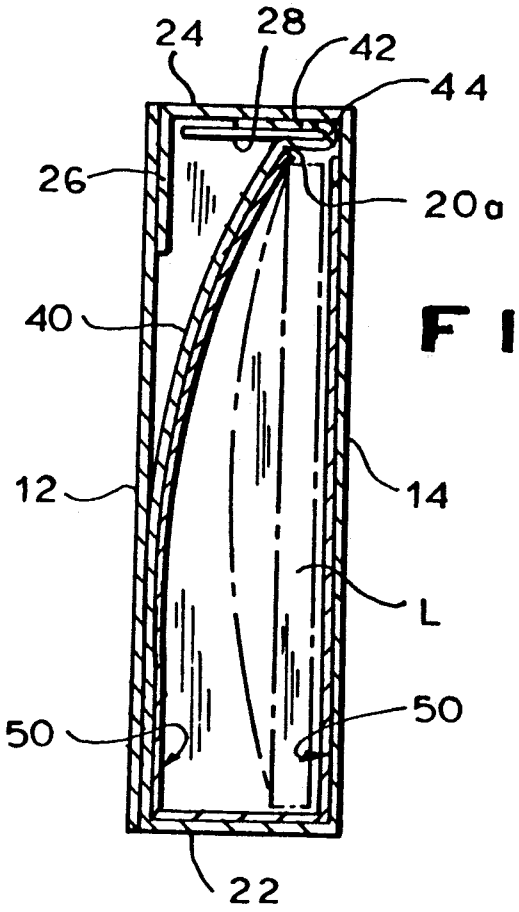
FIG. 6 is a sectional view similar to FIG. 5, but with a thin lens blank being illustrated in a phantom line.
Figure 5:
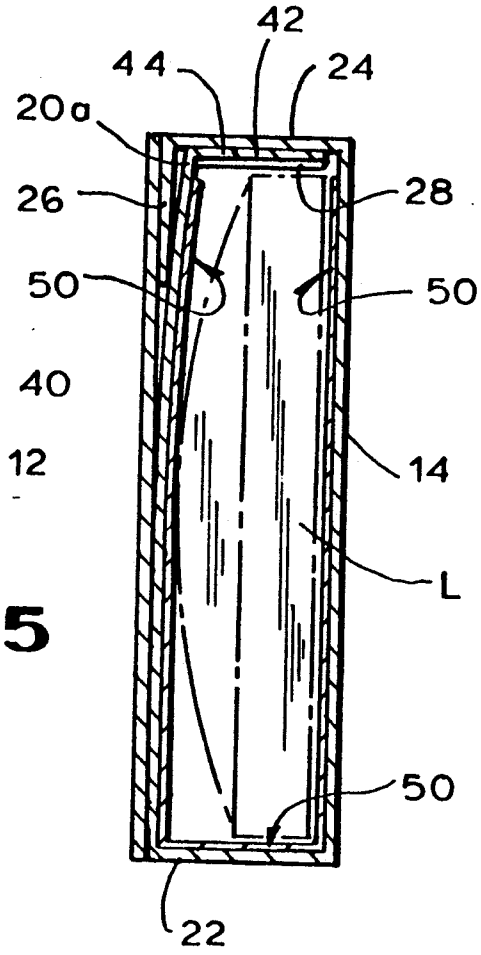

Referring now to FIGS. 3, 4 and 5, therein illustrated is the package 60 in its closed orientation in conjunction with a lens blank L. FIG. 6 shows the carton 60 in its closed position with a thin lens blank therein. The differences will be discussed below.

As shown in FIG. 3, when lens blank L is placed within the carton 60 and the carton is closed, the lens blank is supported on its bottom against the inner surface of the bottom major end panel 22, at its sides by the minor side panels 16, 18, and at its front and back by the non-abrasive strip 50 mounted to the inside of the back major side panel 14 and the internal major side panel 40, as best shown in FIG. 4.

FIGS. 5 and 6 illustrate the use of the carton 60 of the present invention to retain a thick lens blank L and a thin lens blank L', respectively. Referring in particular to FIG. 5, when a thick lens blank L is placed in the carton 60 in order to close the carton, the dust flaps 28, 28 are first pivoted about their respective foldlines 20 to a horizontal position. Next, the internal major end flap 42 is folded downwardly thereover to the horizontal position, and the top major panel 24 is folded downwardly thereover to the horizontal position as well, with the tuck flap 26 being inserted intermediate the internal panel 40 and the front panel 12. Preferably, the foldline intermediate the tuck flap 26 and the top major end panel 24 defines cuts adjacent the ends thereof for engagement by the forward aspects of the dust flaps 28, 28 thereby to prevent accidental displacement of the cover 24, 26 from the closed orientation.

Positioning of the internal major end flap 42 over the dust flaps 28, 28 and the frictional engagement of the internal major end flap 42 between the dust flaps 28, 28 and the top major end panel 24 retains the bottom major end panel 22 in the closed orientation shown in FIG. 2 and prevents the carton from inadvertently opening.

Referring now to FIG. 6 in particular, when a thin lens blank L' is inserted into the package, the package is moved from its open orientation (as illustrated in FIG. 2) to its closed orientation by first pivoting the dust flaps 28, about their respective foldlines 20 to a horizontal position. Next, the internal flap 42 is pivoted about foldline 20*a* to the horizontal position and then the free edge thereof is bent upwardly about the line of weakness 44 until the free edge is rotated backwards to the horizontal position on the top of the dust flaps 28. Next, the cover 24, 26 is moved to the same closed orientation as with a thick lens blank L. The bending of the internal flap 42 about the line of weakness 44 and locating such flap on top of the dust flaps 28, 28 causes the top of the internal major sidewall 40 to move towards the back major sidewall 14 thereby stabilizing the position of the lens within the storage package 60 to minimize and generally preclude abrasion of to the major lens blank surfaces. As with the thick lens blank L, the location of the internal flap 42 between the dust flaps 28, 28 and the cover 24, 26 prevents the bottom major panel 22 from falling through.

It will be appreciated that the advantages described above with regard to a single package which could accommodate both a thin lens blank and a thick lens blank are is equally applicable when the package is devoid of any non-abrasive material 50 or when foam or other non-abrasive material is used to line a similar portion of the carton. Accordingly, the present invention encompasses the package 60 both with and without a non-abrasive material 50 disposed as mentioned above. For example, the package 60 without the non-abrasive material 50 may be used instead of a conventional package simply because it is capable of accommodating both thin and thick lens blanks while allowing only a minimum of movement by the lens relative to the package.

The non-abrasive material 50 may be applied to the opposing surfaces of the two major side panels separately. This material is applied as a single strip of material which covers the two opposing surfaces plus an interior surface of either the bottom major end panel 22 (as illustrated) or one or both of the minor side panels 16, 18. The non-abrasive material and any of the non-abrasive materials, commonly used in the lens field and may be applied to the opposing surfaces of the major face panels by a small amount of glue intermediate each end of the strip and its respective major side panel surface. Application of the non-abrasive material 50 to the blank 10 lends itself to mechanization during carton manufacture, thereby substituting the automatic application of the non-abrasive material to the carton 60 for what had been a manual wrapping operation.

Referring now particularly to FIG. 7, therein illustrated is the manner in which a lens blank L (whether a thick lens blank L or a thin lens blank L') may be removed from the carton 60. With the carton 60 in the open orientation (as illustrated in FIG. 2) the internal flap 42 is gently pulled upwardly, thereby causing a corresponding movement of the internal panel 40, and the upward pivoting of the bottom major end panel 22 about its foldline with the back major panel 14. This action causes the lens blank L to have its upper surface lifted above the level of the front and back major side panels 12, 14, thereby facilitating its removal from the package 60.

It will be appreciated that the lifting of the lens blank L by the bottom major end panel 22 does not exert any pressure on the major faces of the lens blank. Accordingly, the package 60 may be operated in this mode either with the presence of the non-abrasive material 50 (as illustrated) or without the same. However, the presence of the non-abrasive material 50 is greatly preferred since the movement of the lens blank relative to the package while the major lens and surfaces are in contact with either the internal panel 40 or the back major side panel 14 may otherwise lead to damage of the lens blank's major surfaces.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A lens blank package comprising a parallelepiped carton defining:

(A) front and back major side panels;

(B) a pair of minor side panels connected to said major side panels by foldlines;

(C) at a bottom end of said carton, a bottom major end panel connected to said back major side panel by a foldline;

(D) at a top end of said carton:

(i) a top major end panel connected to one of said back or front major side panels by a foldline;

(ii) a tuck flap connected to said top major end panel by a foldline; and (iii) a pair of dust flaps connected to said pair of minor side panels by foldlines;

(E) an internal major side panel connected to said bottom major end panel by a foldline and extending generally parallel and adjacent to said front major side panel; and (F) an internal major end flap connected to said internal major side panel by a given foldline.

2. The package of claim 1 wherein said internal major end flap defines a line of weakness parallel to and closely spaced from said given foldline.

3. The package of claim 1 wherein said internal major end flap is disposed over said dust flaps when said package is closed, thereby to accommodate a lens blank.

4. The package of claim 1 wherein said internal major end flap is folded about said foldline towards said back major side panel and disposed over said dust flaps when said package is closed, thereby to accommodate a thick lens.

5. The package of claim 2 wherein a portion of said internal major end flap is folded about said foldline towards said back major side panel and folded about said line of weakness towards said front major side panel and is disposed over said dust flaps when said package is closed, thereby to limit movement of a thin lens in said package.

6. The package of claim 1 additionally including a strip of non-abrasive material on the facing surfaces of two of said major side panels.

7. The package of claim 6 wherein said strip is a single U-shaped strip extending over the facing surfaces of said back and internal major side panels and the inner surface of said bottom major end panel.

8. The package of claim 7 wherein said single strip extends downwardly from adjacent the top of one of said major side panels, transversely across said bottom major end panel, and upwardly to adjacent the top of the other of said major side panels.

9. The package of claim 1 wherein said bottom major end panel is pivotable about said foldline connecting said internal major side panel and said bottom major end panel.

10. The package of claim 9 wherein said bottom major end panel is connected to said internal major side panel such that upward movement of said internal major side panel causes said bottom major end panel to pivot upwardly and thereby elevate a lens blank resting thereon to facilitate removal of the lens blank from said carton.

11. The package of claim 1 wherein said package is erected by moving said pair of minor side panels together and moving said internal major side panel upwardly.

12. A lens blank package comprising a parallelepiped carton defining:

(A) front and back major side panels;

(B) a pair of minor side panels connected to said major side panels by foldlines;

(C) at a bottom end of said carton, a bottom major end panel connected to said back major side panel by a foldline;

(D) at a top end of said carton:

(i) a top major end panel connected to one of said back or front major side panels by a foldline;

(ii) a tuck flap connected to said top major end panel by a foldline; and (iii) a pair of dust flaps connected to said pair of minor side panels by foldlines;

(E) an internal major side panel connected to said bottom major end panel by a foldline and extending generally parallel and adjacent to said front major side panel;

(F) an internal major end flap connected to said internal major side panel by a given foldline and defining a line of weakness parallel to and closely spaced from said given foldline; and (G) a single U-shaped strip of non-abrasive material on the facing surfaces of said back and internal major side panels extending downwardly from adjacent the top of one of said major side panels, transversely across said bottom major end panel, and upwardly to adjacent the top of the other of said major side panels.

13. The package of claim 12 wherein said internal major end flap is folded about said given foldline towards said back major side panel and disposed over said dust flaps when said package is closed to accommodate a thick lens and is folded about said given foldline towards said back major side panel and folded about said line of weakness towards said front major side panel and is disposed over said dust flaps when said package is closed to accommodate a thin lens blank and said tuck flap is disposed over said internal major end flap.

14. The package of claim 12 wherein said bottom major end panel is pivotable about said foldline connecting said internal major side panel and said bottom major end panel, and said bottom major end panel is connected to said internal major side panel such that upward movement of said internal major side panel causes said bottom major end panel to pivot upwardly and thereby elevate a lens blank resting thereon to facilitate removal of the lens blank from said carton.

15. A blank for a lens blank package in the form of a parallelepiped carton, comprising:

(A) front and back major side panels;

(B) a pair of minor side panels, each connected to at least one of said major side panels by a foldline;

(C) a bottom major end panel connected to said back major side panel by a foldline;

(D) a top major end panel connected to one of said back or front major side panels by a foldline;

(E) a tuck flap connected to said top major end panel by a foldline;

(F) a pair of dust flaps, each connected to one of said minor side panels by a foldline;

(G) an internal major side panel connected to said bottom major end panel by a foldline and pivotable thereabout to extend generally parallel and adjacent to said front major side panel in the erected carton; and (H) an internal major end flap connected to said internal major side panel by a given foldline.

16. The blank of claim 15 wherein said internal major end flap defines a line of weakness parallel to and closely spaced from said given foldline.

17. The blank of claim 15 additionally including a strip of non-abrasive material on the facing surfaces of two of said major side panels when the carton is erected.

18. The blank of claim 18 wherein said strip is a single strip extending over both said back and internal major side panels and said bottom major end panel.

19. The blank of claim 18 wherein said single strip extends substantially the length of one of said major side panels, across said bottom major end panel, and substantially the length of the other of said major side panels.

20. The blank of claim 15 wherein the package formed thereby is erectable by moving the minor side panels towards each other and moving said internal major side panel upwardly relative to said back major side panel.

21. A lens blank package comprising a parallelepiped carton defining:

(A) front and back major side panels;

(B) a pair of minor side panels connected to said major side panels by foldlines;

(C) at a bottom end of said carton, a bottom major end panel connected to said back major side panel by a foldline;

(D) at a top end of said carton:

(i) a top major end panel connected to said back major side panel by a foldline;

(ii) a tuck flap connected to said top major end panel by a foldline; and (iii) a pair of dust flaps connected to said pair of minor side panels by foldlines;

(E) non-abrasive material on the facing surfaces of said major side panel.

22. A blank for a lens package in the form of a parallelepiped carton, comprising:

(A) front and back major side panels;

(B) a pair of minor side panels, each connected to at least one of said major side panels by a foldline;

(C) a bottom major end panel connected to said back major side panel by a foldline;

(D) a top major end panel connected to said back major side panel by a foldline;

(E) a tuck flap connected to said top major end panel by a foldline;

(F) a pair of dust flaps, each connected to one of said minor side panels by a foldline; and (G) non-abrasive material disposed on the facing surfaces of said major side panels when the carton is erected.

23. A lens blank package comprising a parallelepiped carton defining:

(A) front and back major side panels;

(B) a pair of minor side panels connected to said major side panels by foldlines;

(C) at a bottom end of said carton, a bottom major end panel connected to said back major side panel by a foldline;

(D) at a top end of said carton:

(i) a top major end panel connected to one of said back or front major side panel by a foldline;

(ii) a tuck flap connected to said top major end panel by a foldline; and (iii) a pair of dust flaps connected to said pair of minor side panels by foldlines;

(E) an internal major side panel connected to said bottom major end panel by a foldline and extending generally parallel and adjacent to said front major side panel; and (F) an internal major end flap connected to said internal major said panel by a given foldline and defining a line of weakness parallel to and closely spaced from said given foldline; said internal major end flap being folded about said given foldline towards said back major side panel and disposed over said dust flaps when said package is closed to accommodate a thick lens and being folded about said given foldline towards said back major side panel and folded about said line of weakness towards said front major side panel and disposed over said dust flaps when said package is closed to accommodate a thin lens blank and said tuck flap is disposed over said internal major end flap.

24. In combination, a lens package and a thin lens, said package comprising a parallelepiped carton defining:

(A) front and back major side panels;

(B) a pair of minor side panels connected to said major side panels by foldlines;

(C) at a bottom end of said carton, a bottom major end panel connected to said back major side panel by a foldline;

(D) at a top end of said carton;

(i) a top major end panel connected to one of said back or front major side panel by a foldline;

(ii) a tuck flap connected to said top major end panel by a foldline; and (iii) a pair of dust flaps connected to said pair of minor side panels by foldlines;

(E) an internal major side panel connected to said bottom major end panel by a foldline and extending generally parallel and adjacent to said front major side panel;

(F) an internal major end flap connected to said internal major side panel by a given foldline and defining a line of weakness parallel to and closely spaced from said given foldline; said internal major end flap being folded about said given foldline towards said back major side panel and folded about said line of weakness towards said front major side panel and disposed over said dust flaps to accommodate said thin lens when said tuck flap is disposed over said internal major end flap; and

25. The combination of claim 24 wherein said package additionally includes a single U-shaped strip of non-abrasive material on the facing surfaces of said back and internal major side panels.

* * * * *